US007500288B2

(12) United States Patent
Chung et al.

(10) Patent No.: US 7,500,288 B2
(45) Date of Patent: Mar. 10, 2009

(54) HINGE

(75) Inventors: Chia-Ko Chung, Shulin (TW); Jia-Yan Jian, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 213 days.

(21) Appl. No.: 11/526,696

(22) Filed: Sep. 26, 2006

(65) Prior Publication Data

US 2008/0092334 A1 Apr. 24, 2008

(51) Int. Cl.
*E05C 17/64* (2006.01)

(52) U.S. Cl. ..... 16/342; 16/374

(58) Field of Classification Search ..... 16/342, 16/277, 337, 386, 374, 341
See application file for complete search history.

(56) References Cited

U.S. PATENT DOCUMENTS 6,230,365 B1 * 5/2001 Lu ..... 16/342
6,671,929 B1 * 1/2004 Lu ..... 16/342
6,820,307 B2 * 11/2004 Lu ..... 16/342
7,124,473 B2 * 10/2006 Lu et al. ..... 16/342
7,380,312 B2 * 6/2008 Ge et al. ..... 16/342
2006/0137142 A1 * 6/2006 Qin et al. ..... 16/342
2007/0119026 A1 * 5/2007 Lee et al. ..... 16/342
2007/0169314 A1 * 7/2007 Lee et al. ..... 16/342
2007/0192994 A1 * 8/2007 Chuang ..... 16/342
2007/0214605 A1 * 9/2007 Tu ..... 16/342

* cited by examiner

*Primary Examiner*—William L. Miller
(74) *Attorney, Agent, or Firm*—Rabin & Berdo, P.C.

(57) ABSTRACT

A hinge has a barrel, a resilient positioning sleeve, a combination leaf-pivot pin and a fastener. The positioning sleeve is mounted rotatably in the barrel and has an inner surface, a stepped expansion slot and at least one flat surface. The expansion slot is formed longitudinally through the positioning sleeve. The flat surface is formed opposite to the expansion slot on the inner surface. The combination leaf-pivot pin has a distal end, a proximal end, a leaf and a pivot pin. The pivot pin protrudes longitudinally from the leaf and has a positioning ring and a connecting shaft. The positioning ring is mounted in the positioning sleeve and has an outer surface and two flat surfaces formed opposite to each other on the outer surface and selectively corresponding to and seating in the flat surface in the positioning ring. The fastener connects to the connecting shaft.

5 Claims, 6 Drawing Sheets

HINGE

BACKGROUND OF THE INVENTION

1. Field of Invention

The present invention relates to a hinge, and more particularly to a hinge that can be positioned accurately.

2. Description of the Related Art

An electronic appliance such as a laptop or a mobile phone has a base, a cover and a hinge. The cover connects to the base and may have a camera lens. The hinge is usually mounted between the base and the cover, pivots to open or close the cover and rotates the cover relative to the base, so the camera lens on the cover is able to rotate and to face different directions.

With reference to FIGS. 5 and 7, a conventional hinge is mounted between a base and a camera lens of an electrical appliance and comprises a hollow barrel (70) and a combination leaf-pivot pin (80).

The barrel (70) is attached to the camera lens and has a through hole and a hollow C-shaped positioning sleeve (71). The through hole is formed coaxially through the barrel (70) and has a surface. With further reference to FIG. 6, the positioning sleeve (71) is resilient, is mounted in the through hole of the barrel (70) and has an inner surface and an expansion slot (711). The expansion slot (711) is formed longitudinally through the positioning sleeve (71). The surface has at least one flat surface (712). One flat surface (712) is formed longitudinally on the surfaceopposite to the expansion slot (711), and another flat surface (712) may be coincident with the expansion slot (711).

The combination leaf-pivot pin (80) is mounted rotatably in the barrel (70) has a leaf and a pivot pin. The leaf is attached to the cover of the electrical appliance and has an inner end. The pivot pin is formed on and protrudes longitudinally from the inner end of the leaf, is mounted in the barrel (70) and has a positioning ring (81). The positioning ring (81) is formed coaxially on the pivot pin, is mounted in the positioning sleeve (71) and has an outer surface and two flat surfaces (811). The flat surfaces (811) are formed opposite to each other on the outer surface of the positioning ring (81), selectively correspond to and mate with the flat surface (712). Each flat surface (811) has two sides.

When the camera lens rotates, the barrel (70) rotates relatively to the combination leaf-pivot pin (80). When the flat surfaces (811) on the positioning ring (81) rotate and detach from the flat surface (712) in the positioning sleeve (71), the positioning sleeve (71) will expand. When the camera lens is positioned, the flat surface (811) on the positioning ring (81) will enter and mate with the flat surface (712) in the positioning sleeve (71) and act as a detent, and the positioning sleeve (71) will retract, so users will feel the camera is positioned.

However, before one flat surface (811) on the positioning ring (81) enters the flat surface (712) in the positioning sleeve (71), the side of the opposite flat surface (811) on the positioning ring (81) will sink into the expansion slot (711), and the positioning sleeve (71) will contract a little. Users easily believe that the camera lens is positioned and stop rotating the camera, so users will be confused.

To overcome the shortcomings, the present invention provides a hinge to mitigate or obviate the aforementioned.

SUMMARY OF THE INVENTION

The primary objective of the present invention is to provide a hinge that can be positioned accurately.

To achieve the objective, the hinge in accordance with the present invention has a barrel, a positioning sleeve, a combination leaf-pivot pin and a fastener. The barrel has a through hole. The through hole is formed coaxially through the barrel. The positioning sleeve is resilient, is mounted in the through hole in the barrel and has an inner surface, a stepped expansion slot and at least one flat surface. The expansion slot is formed longitudinally through the positioning sleeve and allows the positioning sleeve to contract or expand. The flat surface is formed opposite to the expansion slot on the inner surface. The combination leaf-pivot pin has a leaf and a pivot pin. The leaf has a proximal end. The pivot pin is formed on the proximal end of the leaf, is mounted rotatably in the barrel and has a positioning ring and a connecting shaft. The positioning ring is mounted in the positioning sleeve and has an outer surface and two flat surfaces. The flat surfaces are formed opposite to each other on the outer surface of the positioning ring, selectively correspond to the flat surface in the positioning sleeve to allow one of the flat surfaces to seat in the flat surface in the positioning sleeve. The fastener is mounted rotatably on the barrel and holds the barrel on the pivot pin.

Other objectives, advantages and novel features of the invention will become more apparent from the following detailed description when taken in conjunction with the accompanying drawings.

DETAILED DESCRIPTION OF THE INVENTION

Figure 1:
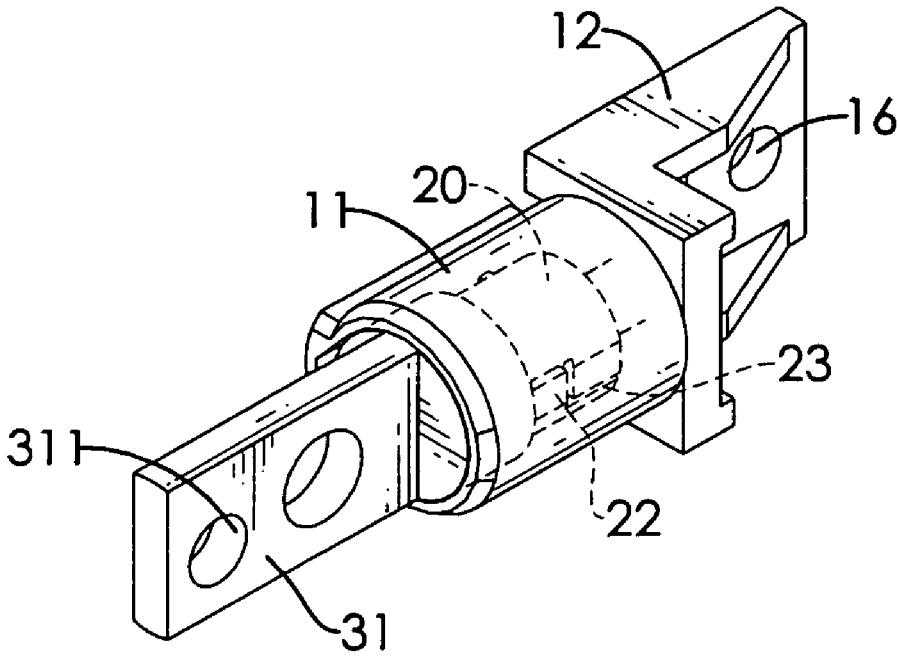
FIG. 1 is a perspective view of a hinge in accordance with the present invention.
Figure 2:
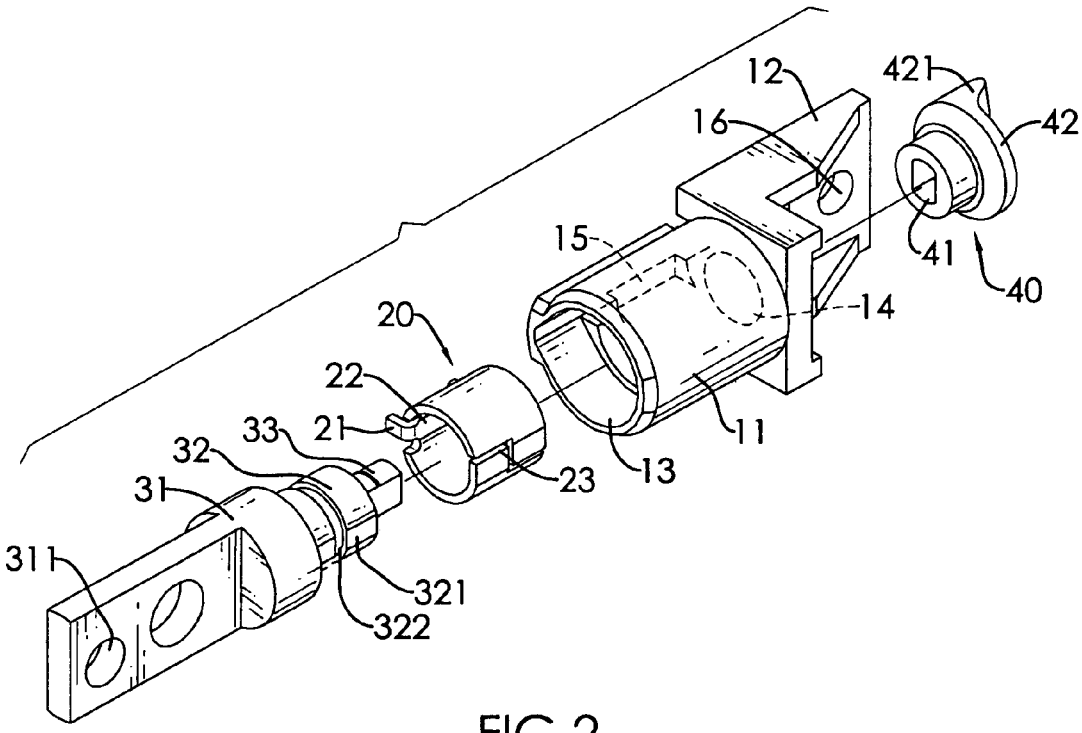
FIG. 2 is an exploded perspective view of the hinge in FIG. 1.
Figure 4:
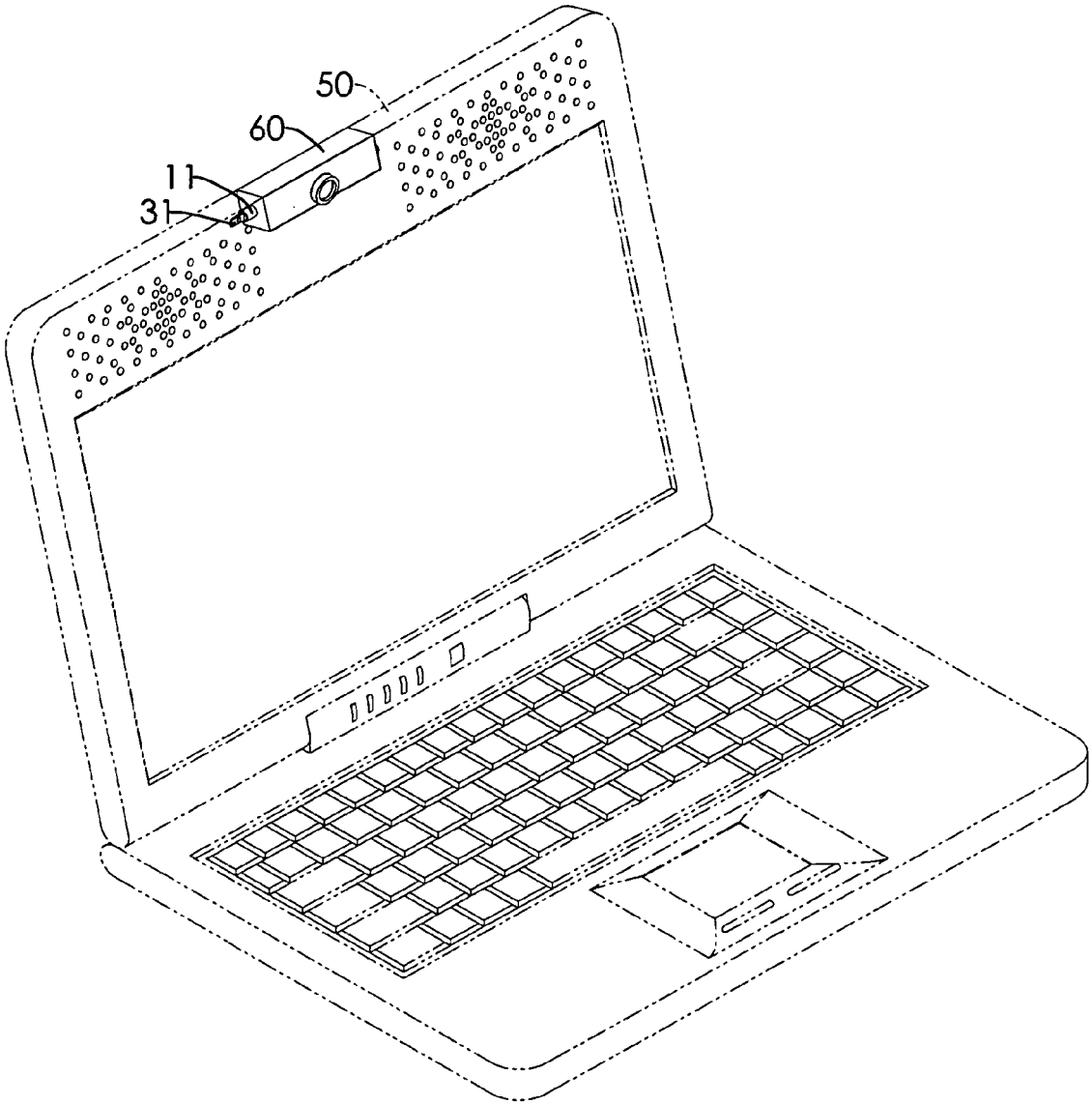
FIG. 4 is an operational perspective view of the hinge in FIG. 1 mounted between a camera lens and a cover of an electronic device.
Figure 5:
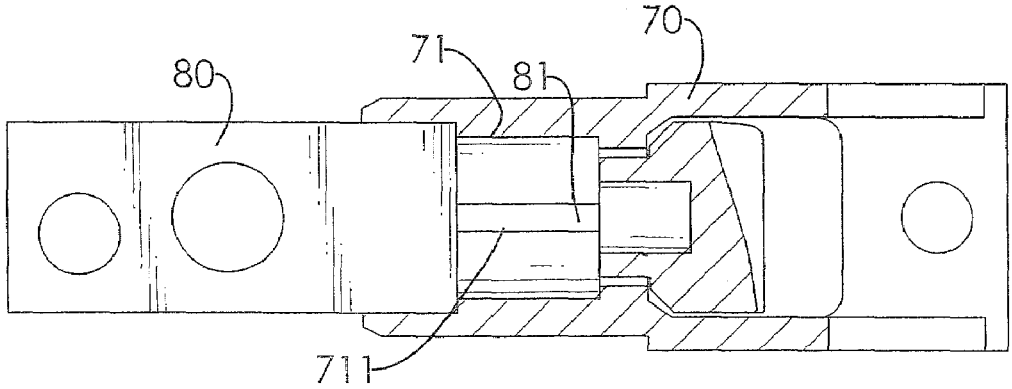
FIG.5 PRIOR ART
FIG. 5 is a side view in partial section of a conventional hinge in accordance with the prior art.
Figure 6:
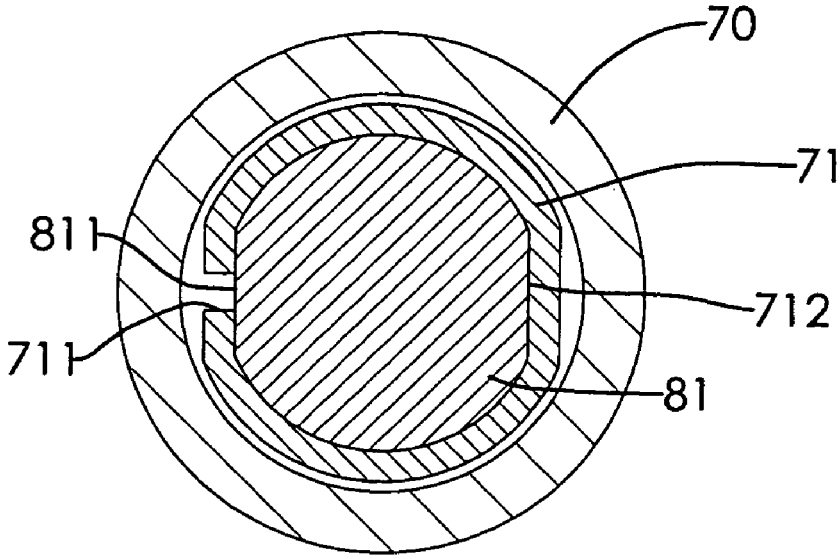
FIG.6 PRIOR ART
FIG. 6 is a cross-sectional end view of the conventional hinge in FIG. 5 with a flat surface on the positioning ring mated with a flat surface in a positioning sleeve.
Figure 7:
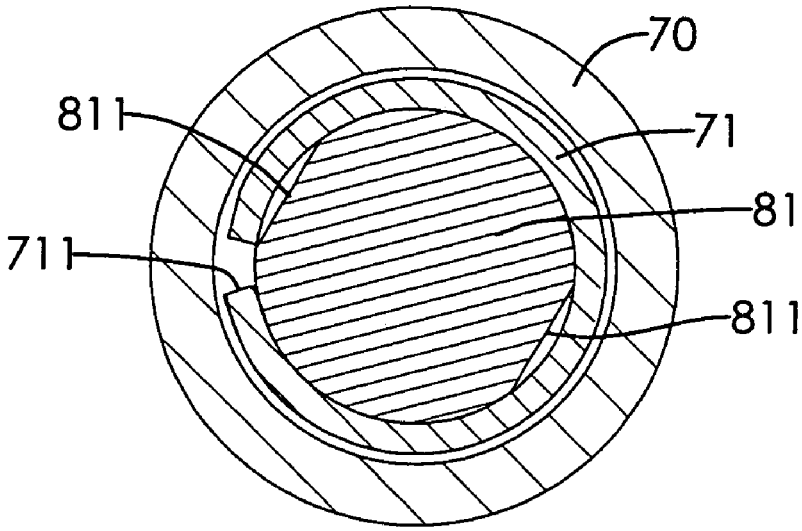
FIG.7 PRIOR ART
FIG. 7 is a cross-sectional end view of the conventional hinge in FIG. 5 before the flat surface on the positioning ring mates with a flat surface in the positioning sleeve.

With reference to FIGS. 1, and 2, a hinge in accordance with the present invention is mounted in an electronic device and has a barrel (11), a positioning sleeve (20), a combination leaf-pivot pin (31) and a fastener (40). With further reference to FIG. 4, the electronic device comprises a cover (50) and a base. The cover (50) has a screen and a camera lens (60). The camera lens (60) is mounted pivotally on the cover (50) and is connected electrically to the electronic device to produce an image on the screen.

The barrel (11) has a through hole, an inner surface, a proximal end (13), a distal end (14) and a leaf (12). The inner surface has a keyway (15). The keyway (15) is formed longitudinally in the inner surface. The leaf (12) is attached to the camera lens (60), is mounted on the distal end (14) of the barrel (11) and has a central hole and at least one mounting hole (16). The central hole aligns coaxially with the through hole in the barrel (11). The mounting hole (16) is formed transversely through the leaf (12) to allow a fastener such as a screw, bolt, rivet or the like to attach the leaf (12) to the camera lens (60).

The positioning sleeve (20) is resilient, is mounted in the through hole in the barrel (11) and has an inner surface, a proximal end, a distal end, two keys (21), a stepped expansion slot (23) and at least flat surface (22). The keys (21) protrude respectively from the proximal end and the distal end and are mounted in the keyway (15) in the barrel (11) to keep the positioning sleeve (20) from rotating in the barrel (11). The expansion slot (23) is formed through the positioning sleeve (20) and allows the positioning sleeve (20) to contract and expand. The at least one flat surface (22) is formed opposite to the expansion slot (23) on the inner surface.

Figure 3:
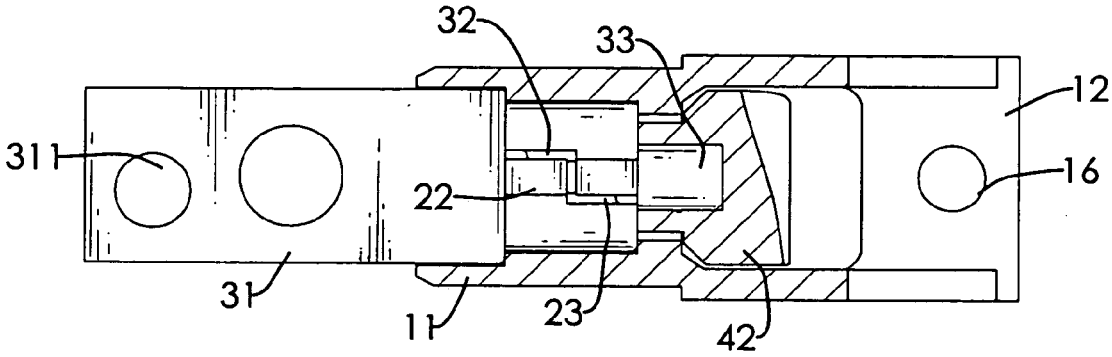
FIG. 3 is a side view in partial section of the hinge in FIG. 1.

With further reference to FIG. 3, the combination leaf-pivot pin (31) is attached to the cover (50) of the electronic device, is mounted rotatably in the barrel (11) and has a proximal end, a distal end, a leaf and a pivot pin.

The leaf is formed at the distal end of the combination leaf-pivot pin (31), extends longitudinally from the proximal end (13) of the barrel (11), is attached to the cover (50) of the electronic device and has a proximal end and at least one mounting hole (311). The mounting hole (311) is formed transversely through the leaf to allow a fastener such as a screw, bolt rivet or the like to attach the leaf to the cover (50).

The pivot pin is formed at the proximal end of the combination leaf-pivot pin (31) and protrudes longitudinally from the leaf at the proximal end thereof, is mounted rotatably in the barrel (11) and has a positioning ring (32) and a connecting shaft (33).

The positioning ring (32) is formed on the pivot pin, is mounted rotatably in the positioning sleeve (20) and has a distal end, an outer surface, two flat surfaces (321) and at least one lubrication groove (322).

The flat surfaces (321) are formed opposite to each other on the outer surface of the positioning ring (32) and selectively correspond to the at least one flat surface (22) in the positioning sleeve (20) to allow one of the flat surfaces (321) to seat in the flat surface (22) in the positioning sleeve (20). Each flat surface (321) has two edges. When the camera lens (60) rotates, the barrel (11) rotates relatively to the combination leaf-pivot pin (31). When the flat surface (321) detaches from the at least one flat surface (22) in the positioning sleeve (20) to rotate, the positioning sleeve (20) will expand. When the camera lens (60) is positioned, the flat surface (321) will seat completely in the at least one flat surface (22) in the positioning sleeve (20), and the positioning sleeve (20) will contract.

The lubrication groove (322) is formed annually in the outer surface and holds lubricant in the lubrication groove (322) to reduce friction and wear between the positioning ring (32) and the positioning sleeve (20).

The connecting shaft (33) is non-circular, is formed on and protrudes coaxially from the distal end of the positioning ring (32) and extends through the central hole in the leaf (12) of the barrel (11).

The fastener (40) is cylindrical, is mounted rotatably in the central hole in the leaf (12) of the barrel (11), connects to the connecting shaft (331), holds the combination leaf-pivot pin (31) in the barrel (11) and has an inner end, an outer end, a central hole (41) and a head (42). The central hole is non-circular, corresponds to the connecting shaft (33) of the combination leaf-pivot pin (31), is formed in the inner end and is mounted on the connecting shaft (33) so the combination leaf-pivot pin (31) will not detach from the barrel (11). The head (42) has a diameter larger than that of the central hole in the leaf (12) of the barrel (11), is formed on the outer end, rotatably abuts the leaf (12) around the central hole in the leaf (12) outside the central hole and may have an outer surface and a protruding tab (421). The protruding tab (421) protrudes from the outer surface of the head (42).

Because the expansion slot (23) is stepped and the edges of the flat surfaces (321) on the positioning ring (32) are straight, the edges of the positioning plane (321) will not sink into the expansion slot (23). The positioning sleeve (11) will contract only when a flat surface (321) on the positioning ring (32) seats in the flat surface (22) in the positioning sleeve (11). Therefore, users will not misunderstand whether the camera lens is positioned or not.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A hinge, comprising:

a barrel having
- a through hole;
- an inner surface having a keyway formed longitudinally in the inner surface;
- a proximal end;
- a distal end; and
- a leaf being mounted on the distal end and having a central hole aligning coaxially with the through hole in the barrel;

a positioning sleeve being resilient, being mounted in the through hole in the barrel and having
- an inner surface;
- a proximal end;
- a distal end;
- two keys protruding respectively from the proximal end and the distal end and being mounted in the keyway in the barrel;
- a stepped expansion slot formed through the positioning sleeve to allow the positioning sleeve to contract and expand; and
- at least one flat surface being formed opposite to the expansion slot on the inner surface;

a combination leaf-pivot pin having
- a proximal end;
- a distal end;
- a leaf being formed at the distal end of the combination leaf-pivot pin, extending longitudinally from the proximal end of the barrel and having a proximal end;
- a pivot pin being formed at the proximal end of the combination leaf-pivot pin and protruding longitudinally from the leaf at the proximal end thereof, being mounted rotatably in the barrel and having
  - a positioning ring being formed on the pivot pin, being mounted rotatably in the positioning sleeve and having
    - a distal end;
    - an outer surface; and
    - two flat surfaces being formed opposite to each other on the outer surface of the positioning ring and selectively corresponding to the at least one flat surface in the positioning sleeve;
  - a connecting shaft being non-circular, being formed on and protruding coaxially from the distal end of the positioning ring and extending through the central hole in the leaf of the barrel; and a fastener being cylindrical, being mounted rotatably in the central hole in the leaf of the barrel, connecting to the connecting shaft and holding the combination leaf-pivot pin in the barrel.

2. The hinge as claimed in claim 1, wherein the leaf of the barrel further has at least one mounting hole formed transversely through the leaf; and the leaf of the combination leaf-pivot pin further has at least one mounting hole formed transversely through the leaf.

3. The hinge as claimed in claim 1, wherein the positioning ring further has at least one lubrication groove formed annually in the outer surface and holding lubricant.

4. The hinge as claimed in claim 1, wherein the fastener further has an inner end;

an outer end;

a central hole being non-circular; corresponding to the connecting shaft of the combination leaf-pivot pin; formed in the inner end and mounted on the connecting shaft; and a head having a diameter larger than that of the central hole in the leaf of the barrel, formed on the outer end rotatably abutting the leaf around the central hole in the leaf outside the central hole.

5. The hinge as claimed in claim 4, wherein the head of the fastener further has an outer surface; and a protruding tab protruding from the outer surface.

* * * * *